United States Patent [19]

Sano

[11] 4,094,089

[45] June 13, 1978

[54] JUMPING RAIL

[75] Inventor: Hiroshi Sano, Tokyo, Japan

[73] Assignee: Tomy Kogyo Co., Inc., Tokyo, Japan

[21] Appl. No.: 756,701

[22] Filed: Jan. 4, 1977

[30] Foreign Application Priority Data

Apr. 22, 1976 Japan ..... 51/50387[U]

[51] Int. Cl.[2] ..... A63H 18/16

[52] U.S. Cl. ..... 46/1 K

[58] Field of Search ..... 46/1 K, 202; 104/54, 104/147 A, DIG. 1; 238/10 R, 10 A

[56] References Cited

U.S. PATENT DOCUMENTS

| | | | |
|---|---|---|---|
| 3,548,534 | 12/1970 | Beny et al. | 46/1 K |
| 3,599,365 | 8/1971 | Carver et al. | 46/1 K X |
| 3,858,875 | 1/1975 | Nemeth et al. | 46/202 X |

FOREIGN PATENT DOCUMENTS

| | | | |
|---|---|---|---|
| 1,905,263 | 8/1970 | Germany | 46/1 K |

*Primary Examiner*—F. Barry Shay

*Attorney, Agent, or Firm*—Staas & Halsey

[57] ABSTRACT

A jumping rail to be positioned within a trackway having a base, a platform defining a path and mounted to pivot with respect to the base between a first position wherein the platform is aligned with the base to permit a vehicle after passing over the platform to continue travelling along the trackway and a second position wherein the platform is raised upwardly from the base causing the vehicle to jump, a mechanism for normally urging the platform to its second position, a striking member extending from the base upwardly through part of the path defined by the platform and mounted to move between a first position wherein the striking member engages the platform retaining the platform in its first position and a second position wherein the striking member disengages from the platform permitting the platform to move to its second position, and an additional retaining mechanism for rendering the striking member inoperable so as to continuously retain the platform in its first position.

10 Claims, 3 Drawing Figures

10
12
14
14
16
18
20
22
24
26
28
30
32
34
40
49
50
52
54
56
58
60
61

JUMPING RAIL

BACKGROUND AND SUMMARY OF THE INVENTION

The present invention relates to a jumping rail which is positioned between sections of a trackway along which toy vehicles move. The jumping rail features a striking member which extends into the path of travel of the vehicles such that if the vehicles engage any part of the striking member a platform which is pivotally mounted to the base of the jumping rail is automatically caused to pivot upwardly causing the vehicles to jump into the air. Where the vehicles move along the platform past the striking member without engaging same the platform remains aligned with the base thus permitting the vehicle to leave the platform and continue to move along the trackway.

DESCRIPTION OF THE PREFERRED EMBODIMENT

Figure 1:
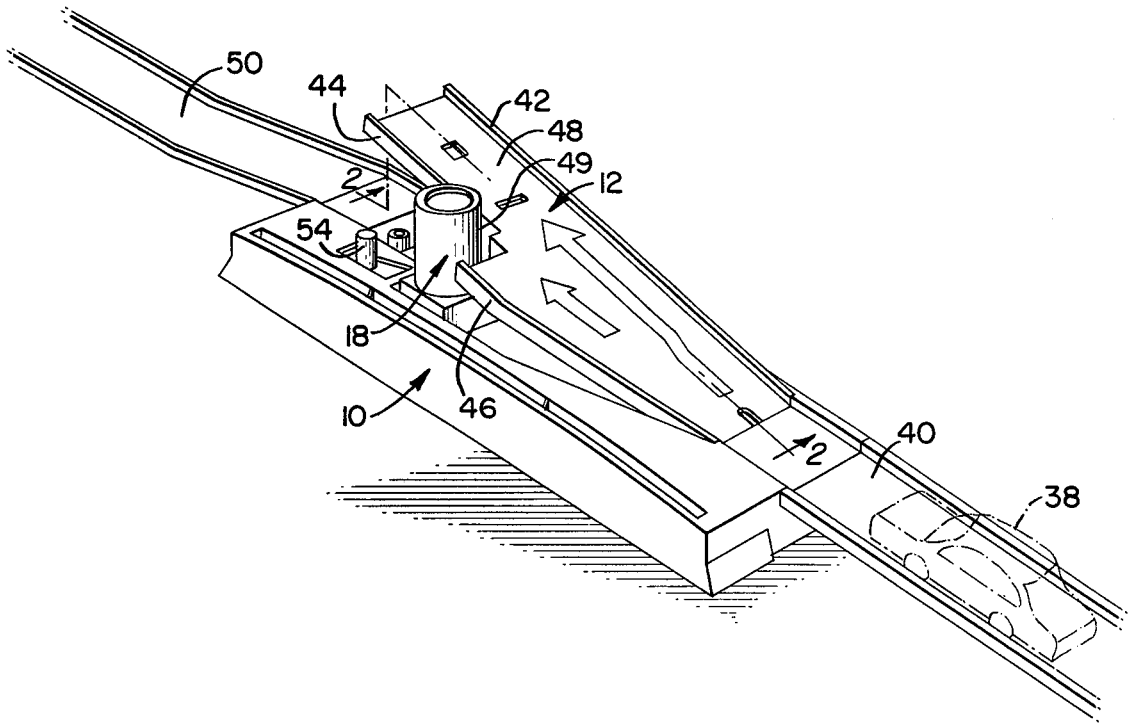
FIG. 1 is a perspective view of the jumping rail, illustrating the platform in raised position whereby a vehicle travelling along the trackway will be propelled upwardly into the air.

The jumping rail of the present invention includes a base 10 to which a platform 12 is mounted for rotation. The platform 12, as illustrated in FIG. 3, includes at one end thereof two shafts 14 which are appropriately mounted to the base 10 so as to permit the platform 12 to rotate relative to the base 10. A spring 16 is interposed between the base 10 and the platform 12 with the use of the disk 17 which rests against the flange 19 and the fastener 21 for the purpose of normally urging the platform 12 upwardly to the position illustrated in FIG. 2.

A striking member generally designated by the reference numeral 18 includes a plate 20 which is provided with a shaft 22 at one end thereof which is appropriately mounted within a ring 24 extending upwardly from the bottom of the base 10. A similar arrangement (not illustrated) is provided at the other end of the plate 20, thus permitting the striking member 18 to pivot relative to the base 10. A spring 26 has one end thereof attached to an arm 28 extending upwardly from the plate 20 and the other end thereof secured to a fastener 30 provided on the base 10. Thus, the spring 26 normally urges the striking member 18 in a counterclockwise direction, as illustrated in FIG. 3.

Figure 2:
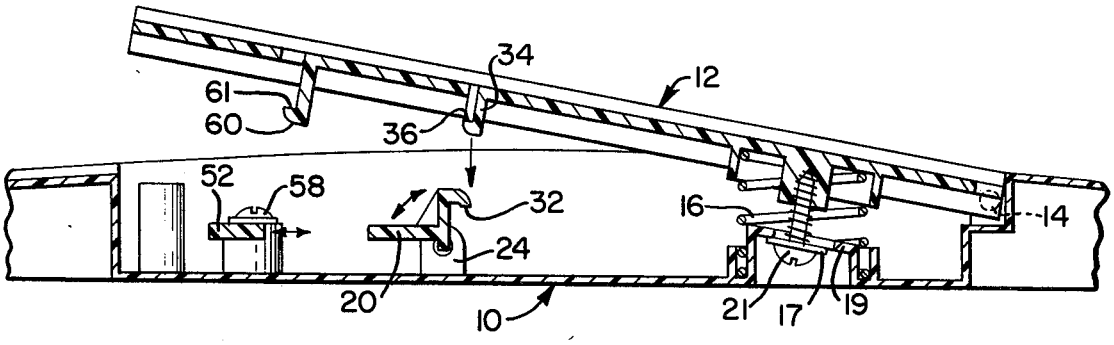
FIG. 2 is a sectional view taken along line 2—2 of FIG. 1, illustrating the automatic and manual over-ride latching mechanisms which when released are responsible for causing the platform to be raised to its elevated position under the influence of a spring.
Figure 3:
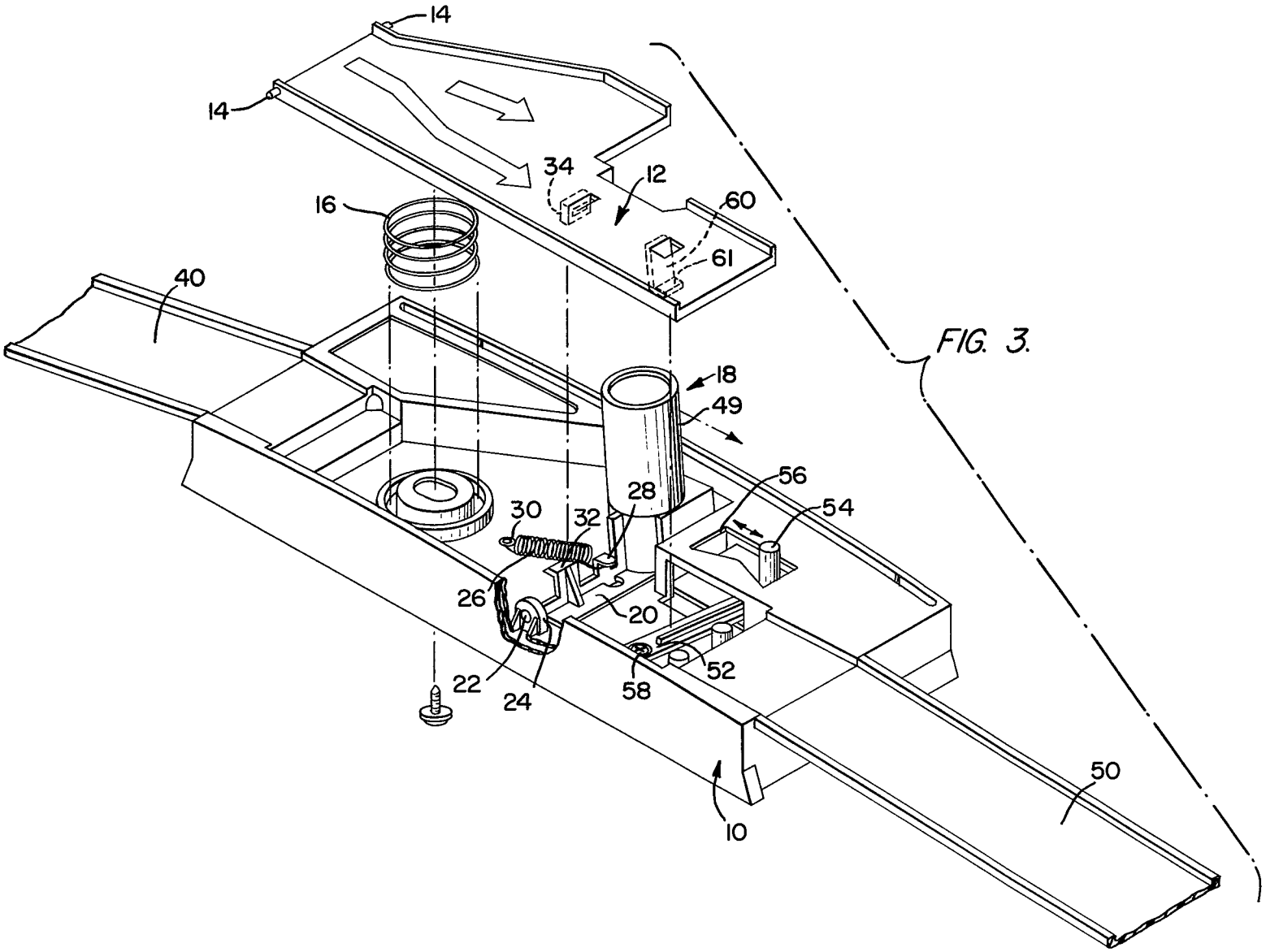
FIG. 3 is an exploded perspective view of the jumping rail, illustrating the base to which the platform is pivotally mounted, the striking member which is pivotally mounted to the base and normally biased in a first position to retain the platform in its lower position level with the base but which when struck by the vehicle moves to a second position releasing the platform permitting same to move under the influence of a spring to its raised position causing the vehicle travelling along the trackway to be propelled upwardly into the air.

The striking member 18 is also provided with a hook element 32 which extends upwardly from the plate 20, while the platform 12 is provided, as illustrated in FIG. 2, with an abutment 34 extending downwardly therefrom. Thus, when the striking member 18 under the influence of the spring 26 is urged to the position shown in FIG. 3, the hook-element 32 is seated on the surface 36 of the abutment 34 thus retaining the platform 12 in its lower position wherein it is aligned with the base 10. When the striking member 18 is rotated clockwise, as illustrated in FIG. 3, the hook-element 32 also rotates thus disengaging from the surface 36 of the abutment 34 releasing the platform 12 at which time the spring 16 forces the platform 12 upwardly into the position illustrated in FIG. 1. When the platform 12 is thus raised, the toy vehicle 38 travelling along the section 40 of the trackway, as illustrated in FIG. 1, will be propelled upwardly into the air. From FIG. 1 it will be apparent that the platform 12 includes upwardly extending rails 42, 44, and 46 which define a path of travel for the vehicle 38. It is possible for the vehicle 38 to pass through the path 48 without engaging the striking member 18 and continue along the adjoining section 50 of the trackway. But should the vehicle 38 veer to the left toward the rail 46 and strike the sidewall 49 of the striking member 18, the striking member 18 is moved against the force of the spring 26 thus releasing the platform 12 to rise under the influence of spring 16 to its raised position. The movement of the vehicle 38 may direct the vehicle 38 from section 40 to section 50 of the trackway without touching the striking member 18, but sometimes the vehicle 38 will veer slightly to the left, at which time the left front portion of the vehicle 38 will strike the sidewall 49 of the striking member 18.

To retain the platform 12 in its lowermost position wherein "jumping" is never possible, there is also provided a lever 52 which, as illustrated in FIG. 3, includes at one end thereof an arm 54 which extends upwardly through an opening 56 provided in the base 10. The other end of the lever 52 is mounted with a fastener 58 to the base 10 permitting the lever 52 to rotate. The platform 12 is also provided with a second abutment 60 extending downwardly therefrom which includes a surface 61 which is engaged by the lever 52 only when the handle 54 is rotated counterclockwise, as illustrated in FIG. 3. In this position the lever 52 is directly above and in engagement with the surface 61 of the hook-element 60 thus preventing the platform 12 from being raised even when the striking member 18 is engaged. When the handle 54 is moved clockwise, as illustrated in FIG. 3, the lever 52 is disengaged from the surface 61 of the hook-element 60, at which time engagement of the vehicle 38 against the striking member 18 will cause the platform 12 to pivot upwardly causing the vehicle 38 to jump.

I claim:

1. A jumping rail, comprising a base having an upper surface, a platform having an upper surface, means mounting said platform to said base to move between a first position wherein said platform upper surface is aligned with said base upper surface and a second position wherein one end of said platform is raised upwardly from said base, means urging said platform to said second position, a striking member projecting upwardly from said base beyond said upper surfaces, means mounting said striking member to said base to move between a first position wherein said striking member engages said platform retaining said platform in its first position and a second position wherein said striking member is disengaged from said platform permitting said platform to move to its second position, means urging said striking member to its first position, and releasable means maintaining said platform in its first position regardless of the position of said striking member.

2. A jumping rail as in claim 1, including means defining a path along said platform, said striking member being positioned along part of said path.

3. A jumping rail as in claim 2, wherein said striking member includes a hook that engages an abutment on said platform when said striking member is in said first position.

4. A jumping rail as in claim 1, wherein said releasable means maintaining said platform in its first position comprises an abutment extending downwardly from said platform, and a rotatably mounted lever within said base mounted to move between a first position wherein said lever engages said abutment maintaining said platform in its first position and a second position wherein said lever is disengaged from said abutment at which time said platform is free to move to its second position when said striking member moves to its second position.

5. A jumping rail as in claim 1, further comprising two sections of trackway, said jumping rail positioned between said sections.

6. A jumping rail as in claim 5, wherein said platform includes means defining a path that connects said sections, said path including a widened area, said striking member being positioned within said widened area.

7. A jumping rail as in claim 1, wherein said means mounting said platform to move comprises pins extending outwardly from one end of said platform, and openings within said base into which said pins extend permitting said platform to rotate relative to said base about an axis corresponding to said pins.

8. A jumping rail as in claim 1, wherein said means urging said platform to said second position comprises a spring interposed between said base and said platform near said one end of said platform.

9. A jumping rail as in claim 1, wherein said means mounting said striking member to move comprises a plate upon which said striking member is mounted, pins extending outwardly from said plate, and openings provided within said base through which said pins extend permitting said plate to pivot with respect to said base.

10. A jumping rail as in claim 9, wherein said means urging said striking member to its first position comprises a spring having one end secured to said base and the other end secured to said plate.

* * * * *